US010376801B1

(12) United States Patent
Morris

(10) Patent No.: US 10,376,801 B1
(45) Date of Patent: Aug. 13, 2019

(54) MAGNETIC TRACKED TOY ASSEMBLY

(71) Applicant: Kevin Morris, St. Louis, MO (US)

(72) Inventor: Kevin Morris, St. Louis, MO (US)

( * ) Notice: Subject to any disclaimer, the term of this patent is extended or adjusted under 35 U.S.C. 154(b) by 0 days.

(21) Appl. No.: 15/925,313

(22) Filed: May 23, 2018

(51) Int. Cl.

| | |
|---|---|
| ***A63H 18/14*** | (2006.01) |
| ***A63H 33/26*** | (2006.01) |
| ***A63H 18/16*** | (2006.01) |
| ***A63H 18/00*** | (2006.01) |
| ***A63H 18/10*** | (2006.01) |
| *B60L 9/00* | (2019.01) |

(52) U.S. Cl.
CPC ..... *A63H 18/14* (2013.01); *A63H 18/002* (2013.01); *A63H 18/10* (2013.01); *A63H 18/16* (2013.01); *A63H 33/26* (2013.01)

(58) Field of Classification Search
CPC .... A63H 17/00; A63H 17/264; A63H 18/208; A63H 19/00; A63H 19/18; B60L 9/00; B60L 11/10; B60L 11/18; B60L 13/00; B60L 13/10
USPC ..... 446/92, 129–139; 104/281, 284
See application file for complete search history.

(56) References Cited

U.S. PATENT DOCUMENTS

| | | | | |
|---|---|---|---|---|
| 3,890,906 | A * | 6/1975 | Maki | B60L 13/10 104/281 |
| 4,229,005 | A | 10/1980 | Barlow | |
| 4,299,173 | A * | 11/1981 | Arima | B60L 13/04 104/281 |
| 4,571,204 | A * | 2/1986 | Wang | A63H 18/028 446/138 |
| 4,852,497 | A | 8/1989 | Tysui | |
| 5,653,173 | A * | 8/1997 | Fischer | B60L 13/10 104/118 |
| 5,681,202 | A * | 10/1997 | Sander | A63H 17/264 213/75 D |
| 5,931,714 | A | 8/1999 | Johnson | |
| 5,974,977 | A | 11/1999 | Johnson | |
| 7,671,712 | B2 | 3/2010 | Elliot | |
| 7,887,388 | B2 | 2/2011 | Holsten | |

* cited by examiner

*Primary Examiner* — Kien T Nguyen

(57) ABSTRACT

A magnetic tracked toy assembly for entertainment includes a panel, which is annular, and plurality of shells. A plurality of rails is coupled to an upper surface of the panel so that the rails extend annularly and in parallel around the panel. A respective groove, which is complementary to the rails, is positioned in a bottom of a respective shell so that the groove is positioned to selectively insert a respective rail. Each shell is coupled to a respective blower module, which in turn is coupled to a respective controller. The panel, the rails and the shells are magnetized so that each shell is repelled by the panel and the respective rail to levitate the shell above the panel. The controller is positioned to command the blower module to selectively expel air to propel the respective shell along the panel with the respective rail positioned to guide the respective shell.

13 Claims, 6 Drawing Sheets

MAGNETIC TRACKED TOY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to toy assemblies and more particularly pertains to a new toy assembly for entertainment.

BRIEF SUMMARY OF THE INVENTION

An embodiment of the disclosure meets the needs presented above by generally comprising a panel, which is annular, and plurality of shells. A plurality of rails is coupled to an upper surface of the panel so that the rails extend annularly and in parallel around the panel. A respective groove, which is complementary to the rails, is positioned in a bottom of a respective shell so that the groove is positioned to selectively insert a respective rail. Each shell is coupled to a respective blower module, which in turn is coupled to a respective controller. The panel, the rails and the shells are magnetized so that each shell is repelled by the panel and the respective rail to levitate the shell above the panel. The controller is positioned to command the blower module to selectively expel air to propel the respective shell along the panel with the respective rail positioned to guide the respective shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
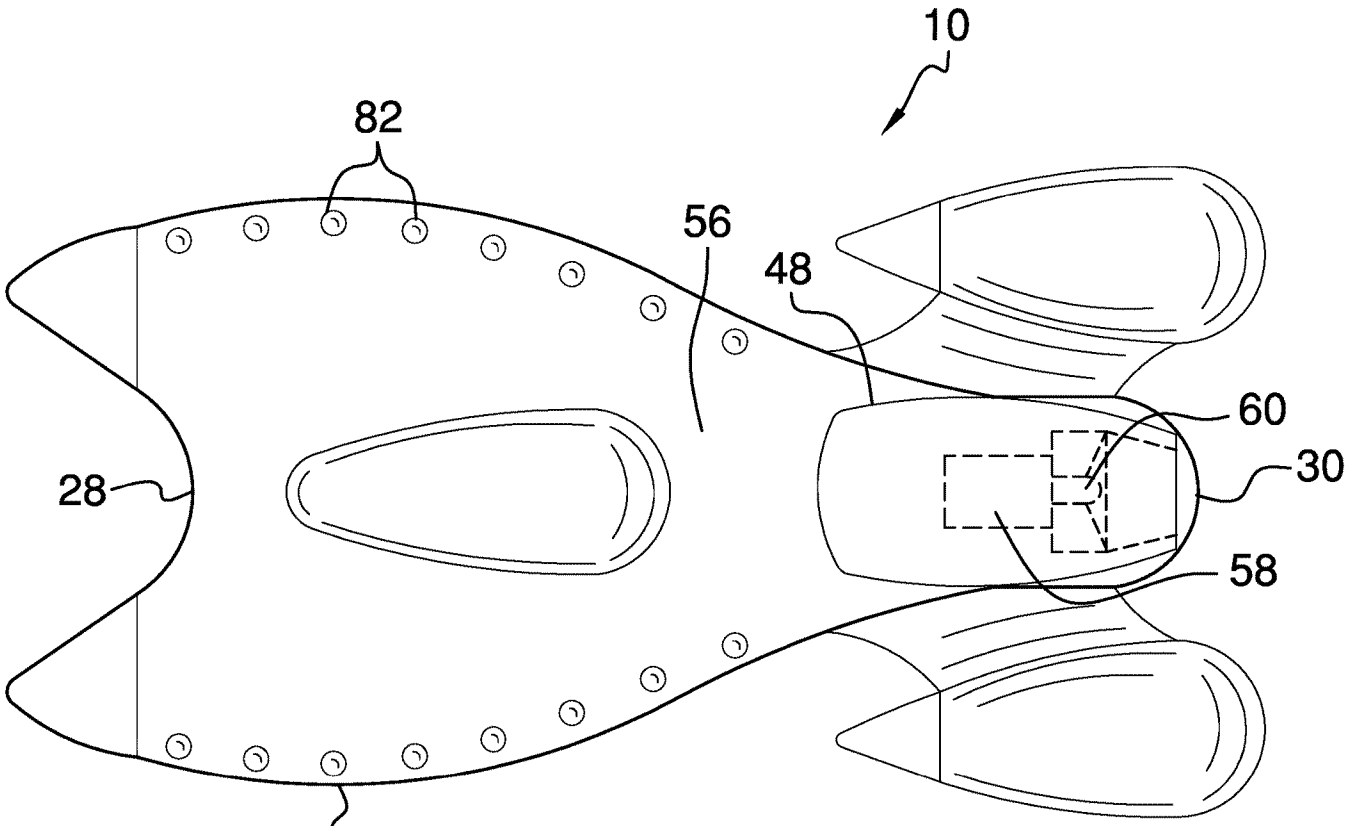
FIG. 1 is a top view of a magnetic tracked toy assembly according to an embodiment of the disclosure.

With reference now to the drawings, and in particular to FIGS. 1 through 6 thereof, a new toy assembly embodying the principles and concepts of an embodiment of the disclosure and generally designated by the reference numeral 10 will be described.

Figure 4:
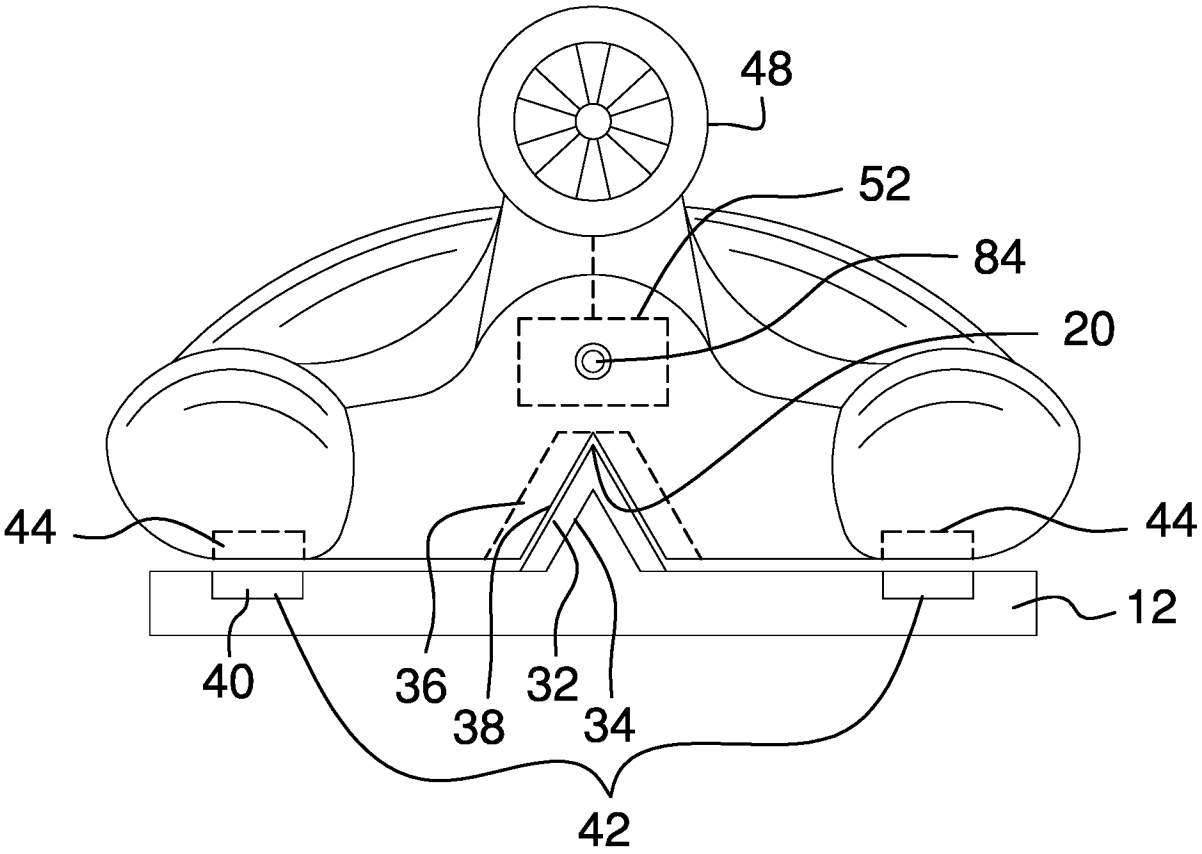
FIG. 4 is a rear view of an embodiment of the disclosure.
Figure 5:
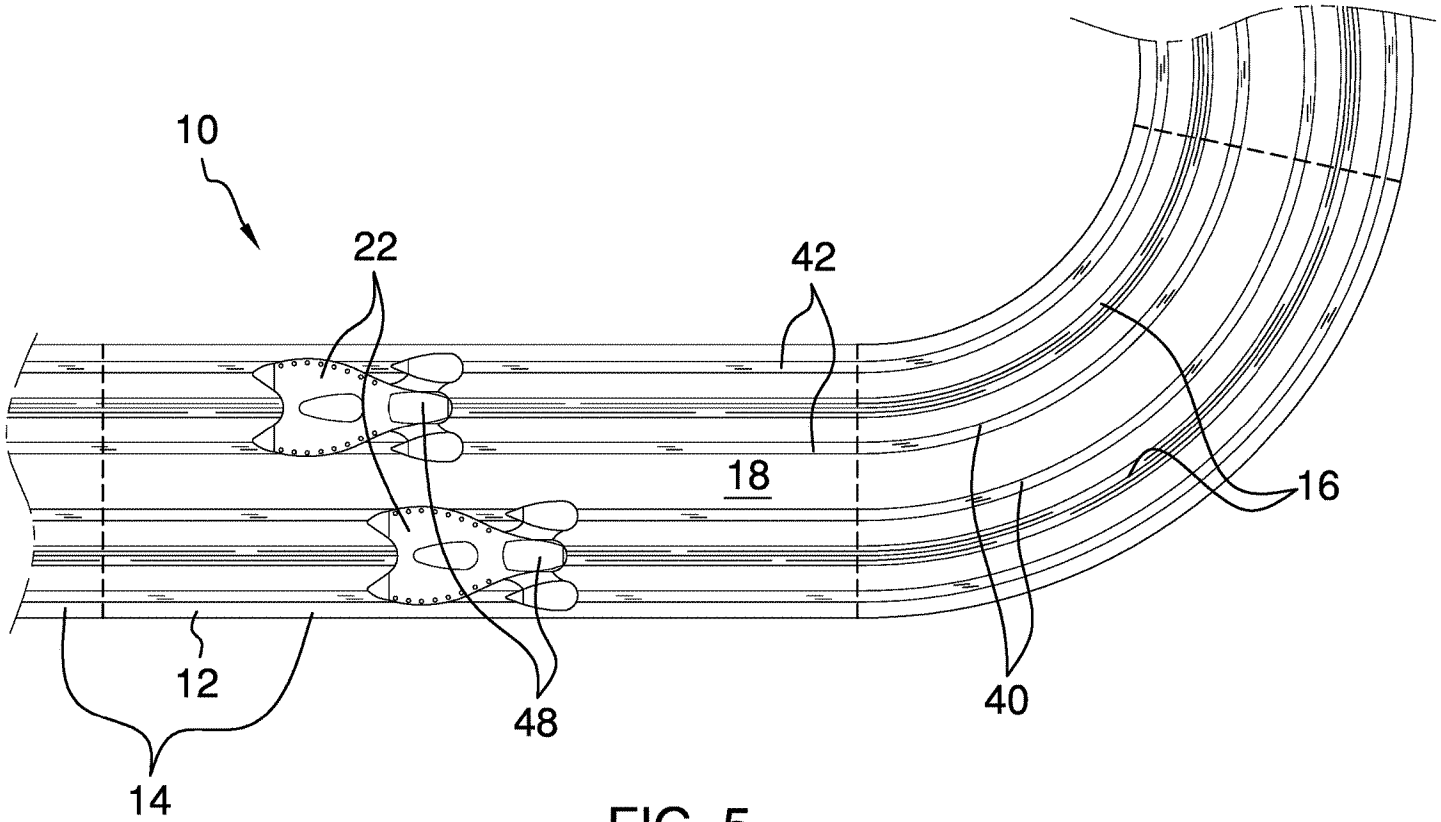
FIG. 5 is an in-use view of an embodiment of the disclosure.

As best illustrated in FIGS. 1 through 6, the magnetic tracked toy assembly 10 generally comprises a panel 12. The panel 12 is annular and magnetized. The panel 12 comprises a plurality of sections 14, as shown in FIG. 5. The sections 14 are selectively interconnectable. Each section 14 has a respective profile so that the plurality of sections 14 comprises a plurality of profiles. The plurality of sections 14 is selectively positionable in a variety of annular configurations.

A plurality of rails 16 is coupled to an upper surface 18 of the panel 12. The rails 16 extend annularly and in parallel around the panel 12. The rails 16 are magnetized. Each rail 16 is V-shaped when viewed longitudinally. An apex 20 of the rail 16 is positioned distal from the panel 12, as shown in FIG. 4. The plurality of rails 16 comprises two rails 16, as shown in FIG. 5.

The assembly 10 comprises a plurality of shells 22. The shells 22 are magnetized so that the shells 22 are repelled by both the panel 12 and the rails 16 so that the shells 22 levitate above the panel 12, as shown in FIG. 4. Each shell 22 has a respective shape so that the plurality of shells 22 comprises a plurality of shapes. Each shape resembles a respective vehicle.

Each shell comprises a pair of discs 86 that is rotationally coupled a bottom 26 of the shell 22. The discs are positioned singly proximate to a front 28 and a rear 30 of the shell 22. Each of a pair of grooves 24 is positioned in a lower surface 88 of a respective disc 86 and extends across a diameter 90 of the respective disc 86. The grooves 24 are complementary to the rails 16. The grooves 24 are positioned to selectively insert a respective rail 16.

Figure 6:
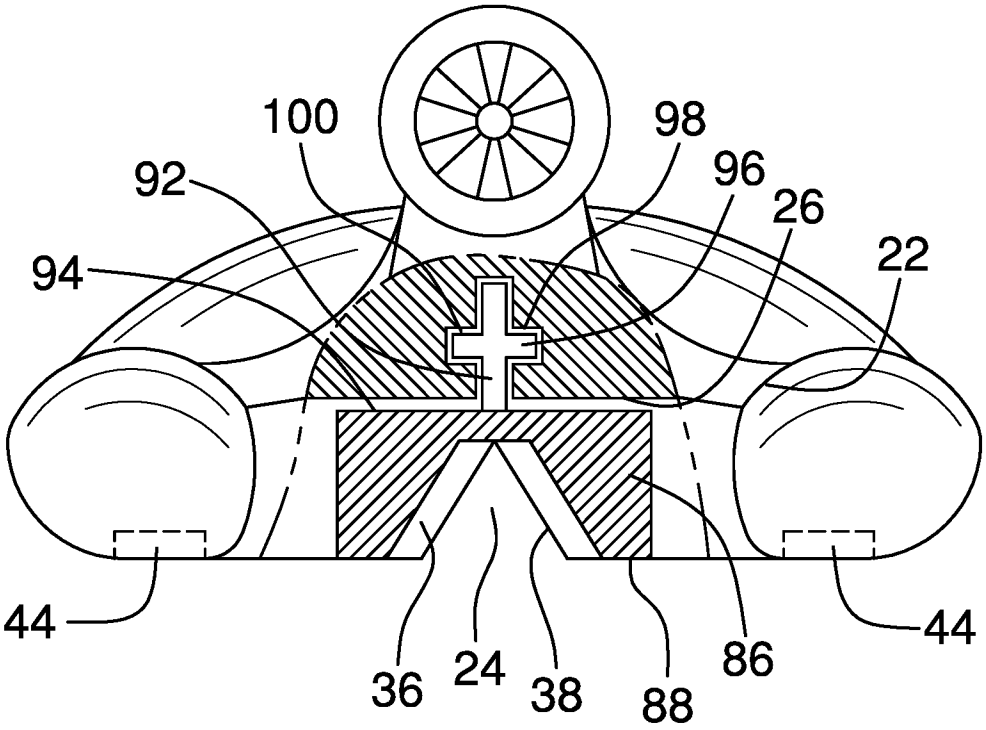
FIG. 6 is a cross-sectional view of an embodiment of the disclosure.

Each of a pair of shafts 92 is axially coupled to an upper surface 94 of a respective disc 86. Each of a pair of rings 96 is coupled to a respective shaft 92. Each shell 22 comprises a pair of recesses 98 that extend into the bottom of the shell 22. The recesses 98 are positioned singly proximate to the front 28 and the rear 30 of the shell 22. Each recess 98 is shaped complementarily to a respective shaft 92 and an associated ring 96. The respective shaft 92 and the associated ring 96 are positioned in the recess 98 to couple the respective disc 86 to the bottom 26 of the shell 22, as shown in FIG. 6. Lubricant 100 is positioned around the respective shaft 92 and the associated ring 96 to facilitate rotation of the respective disc 86 relative to the shell 22.

Each of a plurality of first strips 32, which are magnetic, is coupled to a respective opposing surface 34 of an associated rail 16, as shown in FIG. 4. Each of a plurality of second strips 36, which are magnetic, is coupled to a respective opposing face 38 of an associated groove 24, as shown in FIG. 4. The second strips 36 that are positioned in the associated groove 24 are positioned to repel the first strips 32 that are positioned on the associated rail 16 to levitate the respective shell 22 above the panel 12.

Each of a plurality of third strips 40, which are magnetic, is coupled singly and in parallel proximate to each opposing surface 34 of the associated rail 16 so that each rail 16 is bracketed by a pair of third strips 42, as shown in FIG. 5.

Each of a plurality of magnets 44 is coupled to the bottom 26 of a respective shell 22 so that the magnet 44 is selectively positionable over a respective third strip 40. The pair of third strips 42 is positioned to repel the magnets 44 to stabilize the respective shell 22 relative to the panel 12. The magnets 44 are positioned singly proximate to each corner 46 of the bottom 26 of the respective shell 22.

Each of a plurality of blower modules 48 is coupled to a respective shell 22, as shown in FIG. 1. The blower module 48 is configured to selectively expel air to propel the respective shell 22 along the panel 12.

Figure 2:
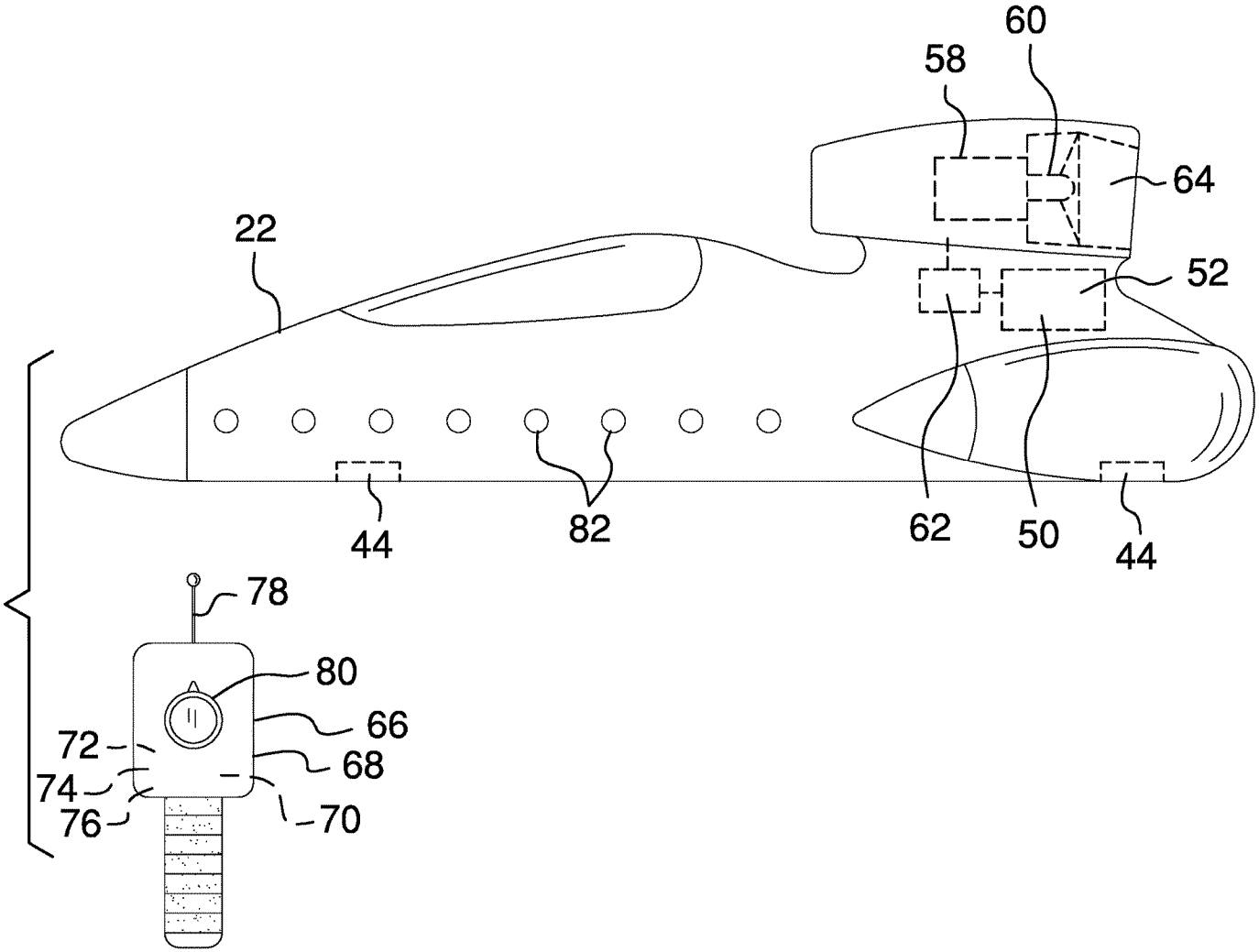
FIG. 2 is a side view of an embodiment of the disclosure.
Figure 3:
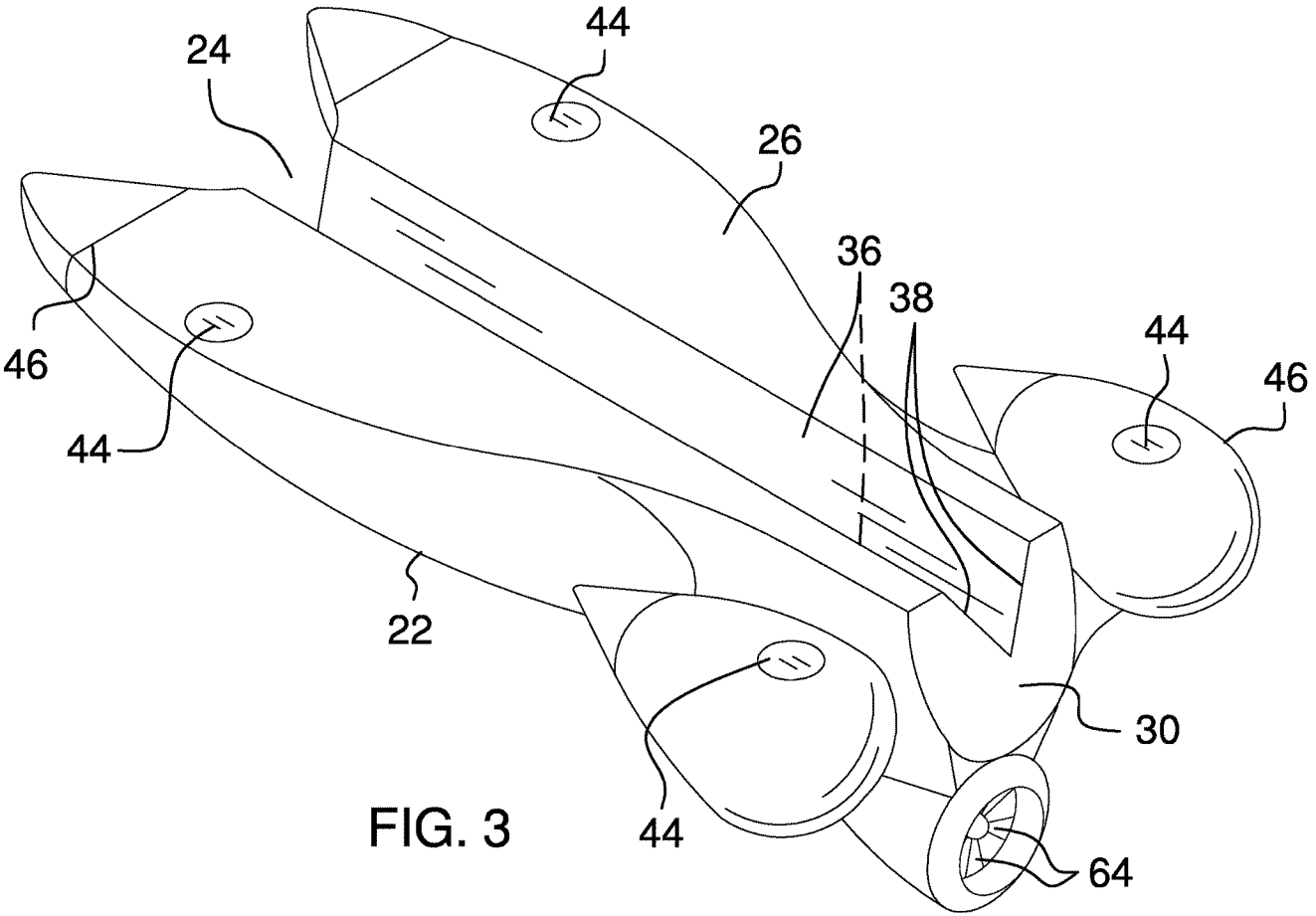
FIG. 3 is an isometric perspective view of an embodiment of the disclosure.

Each blower module 48 comprises a first power module 50 that is coupled to the respective shell 22, as shown in FIG. 2. The first power module 50 comprises a first battery 52. A port 84 positioned in the respective shell 22. The port is operationally coupled to the first battery 52. The port 84 is configured to be coupled to a source of current to recharge the first battery 52.

A tube 54 is coupled to a top 56 of the respective shell 22. The tube 54 is open-ended. A motor 58 is coupled to and is positioned within the tube 54 so that a shaft 60 of the motor 58 extends from the motor 58 toward the rear 30 of the respective shell 22. A receiver 62 is operationally coupled to the first power module 50 and the motor 58. A plurality of blades 64 is coupled to and extends from the shaft 60. The motor 58 is positioned to rotate the blades 64 concurrent with the shaft 60 to expel air from the tube 54 to propel the respective shell 22 along the panel 12.

The assembly 10 comprises a plurality of controllers 66. Each controller 66 is operationally coupled to a respective blower module 48. The controller 66 is positioned to command the respective blower module 48 to selectively expel the air to propel the respective shell 22 along the panel 12. The respective rail 16 positioned to guide the respective shell 22 along the panel 12.

Each controller 66 comprises a housing 68 that defines an interior space 70, as shown in FIG. 2. A second power module 72 is coupled to the housing 68 and is positioned in the interior space 70. The second power module 72 comprises a second battery 74. A transmitter 76 is coupled to the housing 68 and is positioned in the interior space 70. The transmitter 76 is operationally coupled to the second power module 72. An antenna 78 is coupled to and extends from the housing 68. The antenna 78 is operationally coupled to the transmitter 76. A knob 80 is rotationally coupled to the housing 68. The knob 80 is operationally coupled to the transmitter 76. The knob 80 is positioned to be selectively turned to signal the transmitter 76 to wirelessly communicate a respective rotational speed for the shaft 60 to the motor 58 via the receiver 62. A user is positioned to control a speed of the respective shell 22.

A plurality of light emitting diodes 82 is coupled to the top of the respective shell 22. The light emitting diodes 82 are operationally coupled to the first power module 50. The light emitting diodes 82 to illuminate the respective shell 22.

In use, each shell 22 is repelled by the panel 12 and the respective rail 16 to levitate the shell 22 above the panel 12. The controller 66 is positioned to command the respective blower module 48 to selectively expel the air to propel the respective shell 22 along the panel 12. The respective rail 16 is positioned to guide the respective shell 22 along the panel 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A magnetic tracked toy assembly comprising:

a panel, said panel being annular, said panel being magnetized;

a plurality of rails, each said rail being coupled to an upper surface of said panel, said rails extending annularly and in parallel around said panel, said rails being magnetized;

a plurality of shells, said shells being magnetized;

a plurality of grooves, said grooves being complementary to said rails, each said groove being positioned in a bottom of a respective said shell such that said groove is positioned for selectively inserting a respective said rail;

a plurality of blower modules, each said blower module being coupled to a respective said shell such that said blower module is configured for selectively expelling air for propelling said respective said shell along said panel;

a plurality of controllers, each said controller being operationally coupled to a respective said blower module; and wherein said shell, said panel and said rails are magnetized such that each said shell is repelled by said panel and said respective said rail for levitating said shell above said panel, wherein said controller is positioned for commanding said respective said blower module for selectively expelling the air for propelling said respective said shell along said panel with said respective said rail positioned for guiding said respective said shell along said panel.

2. The assembly of claim 1, further including each said rail being V-shaped when viewed longitudinally such that an apex of said rail is positioned distal from said panel.

3. The assembly of claim 1, further including said plurality of rails comprising two said rails.

4. The assembly of claim 1, further comprising:

each said shell comprising a pair of discs rotationally coupled a bottom of said shell, said discs being positioned singly proximate to a front and a rear of said shell;

a pair of grooves, each said groove being positioned in a lower surface of a respective said disc, said grove extending across a diameter of said respective said disc, said grooves being complementary to said rails such that said grooves are positioned for selectively inserting a respective said rail;

a pair of shafts, each said shaft being axially coupled to an upper surface of said respective said disc;

a pair of rings, each said ring being coupled to a respective said shaft;

a pair of recesses extending into said bottom of said shell, said recesses being positioned singly proximate to said front and said rear of said shell, each said recess being shaped complementarily to a respective said shaft and an associated said ring, said respective said shaft and said associated said ring being positioned in said recess for coupling said respective said disc to said bottom of said shell; and lubricant positioned around said respective said shaft and said associated said ring wherein said lubricant is positioned for facilitating rotation of said respective said disc relative to said shell.

5. The assembly of claim 1, further comprising:

a plurality of first strips, said first strips being magnetic, each said first strip being coupled to a respective opposing surface of an associated said rail;

a plurality of second strips, said second strips being magnetic, each said second strip being coupled to a respective opposing face of an associated said groove; and wherein said second strips are positioned on said shells such that said second strips positioned in said associated said groove are positioned for repelling said first strips positioned on said associated said rail for levitating said respective said shell above said panel.

6. The assembly of claim 5, further comprising:

a plurality of third strips, said third strips being magnetic, said third strips being coupled singly and in parallel proximate to each said opposing surface of said associated said rail such that each said rail is bracketed by a pair of said third strips;

a plurality of magnets, each said magnet being coupled to said bottom of a respective said shell such that said magnet is selectively positionable over a respective said third strip; and wherein said magnets are positioned on said shells such that said pair of said third strips is positioned for repelling said magnets for stabilizing said respective said shell relative to said panel.

7. The assembly of claim 6, further including said magnets being positioned singly proximate to each corner of said bottom of said respective said shell.

8. The assembly of claim 1, further including each said blower module comprising:

a first power module coupled to said respective said shell;

a port positioned in said respective said shell, said port being operationally coupled to said first battery, said port being configured for coupling to a source of current for recharging said first battery;

a tube coupled to a top of said respective said shell, said tube being open-ended;

a motor coupled to and positioned within said tube such that a shaft of said motor extends from said motor toward a rear of said respective said shell;

a receiver operationally coupled to said first power module and said motor;

a plurality of blades coupled to and extending from said shaft; and wherein said blades are positioned on said shaft such that said motor is positioned for rotating said blades concurrent with said shaft for expelling air from said tube for propelling said respective said shell along said panel.

9. The assembly of claim 8, further including said first power module comprising a first battery.

10. The assembly of claim 8, further including each said controller comprising:

a housing defining an interior space;

a second power module coupled to said housing and positioned in said interior space;

a transmitter coupled to said housing and positioned in said interior space, said transmitter being operationally coupled to said second power module;

an antenna coupled to and extending from said housing, said antenna being operationally coupled to said transmitter;

a knob rotationally coupled to said housing, said knob being operationally coupled to said transmitter; and wherein said knob is positioned on said housing such that said knob is positioned for selectively turning for signaling said transmitter for wirelessly communicating a respective rotational speed for said shaft to said motor via said receiver such that a user is positioned for controlling a speed of said respective said shell.

11. The assembly of claim 10, further including said second power module comprising a second battery.

12. The assembly of claim 8, further including a plurality of light emitting diodes, said light emitting diodes being coupled to said top of said respective said shell, said light emitting diodes being operationally coupled to said first power module such that said light emitting diodes are positioned for illuminating said respective said shell.

13. A magnetic tracked toy assembly comprising:

a panel, said panel being annular, said panel being magnetized, said panel comprising a plurality of sections, said sections being selectively interconnectable, each said section having a respective profile;

a plurality of rails, each said rail being coupled to an upper surface of said panel, said rails extending annularly and in parallel around said panel, said rails being magnetized, each said rail being V-shaped when viewed longitudinally such that an apex of said rail is positioned distal from said panel, said plurality of rails comprising two said rails;

a plurality of shells, said shells being magnetized such that said shells are repelled by said panel and said rails for levitating said shells above said panel, each said shell having a respective shape;

each said shell comprising a pair of discs rotationally coupled a bottom of said shell, said discs being positioned singly proximate to a front and a rear of said shell;

a pair of grooves, each said groove being positioned in a lower surface of a respective said disc, said grove extending across a diameter of said respective said disc, said grooves being complementary to said rails such that said grooves are positioned for selectively inserting a respective said rail;

a pair of shafts, each said shaft being axially coupled to an upper surface of said respective said disc;

a pair of rings, each said ring being coupled to a respective said shaft;

a pair of recesses extending into said bottom of said shell, said recesses being positioned singly proximate to said front and said rear of said shell, each said recess being shaped complementarily to a respective said shaft and an associated said ring, said respective said shaft and said associated said ring being positioned in said recess for coupling said respective said disc to said bottom of said shell;

lubricant positioned around said respective said shaft and said associated said ring wherein said lubricant is positioned for facilitating rotation of said respective said disc relative to said shell;

a plurality of first strips, said first strips being magnetic, each said first strip being coupled to a respective opposing surface of an associated said rail;

a plurality of second strips, said second strips being magnetic, each said second strip being coupled to a respective opposing face of an associated said groove, wherein said second strips are positioned on said shells such that said second strips positioned in said associated said groove are positioned for repelling said first strips positioned on said associated said rail for levitating said respective said shell above said panel;

a plurality of third strips, said third strips being magnetic, said third strips being coupled singly and in parallel proximate to each said opposing surface of said associated said rail such that each said rail is bracketed by a pair of said third strips;

a plurality of magnets, each said magnet being coupled to said bottom of a respective said shell such that said magnet is selectively positionable over a respective said third strip, wherein said magnets are positioned on said shells such that said pair of said third strips is positioned for repelling said magnets for stabilizing said respective said shell relative to said panel, said magnets being positioned singly proximate to each corner of said bottom of said respective said shell;

a plurality of blower modules, each said blower module being coupled to a respective said shell such that said blower module is configured for selectively expelling air for propelling said respective said shell along said panel, each said blower module comprising:

a first power module coupled to said respective said shell, said first power module comprising a first battery, a port positioned in said respective said shell, said port being operationally coupled to said first battery, said port being configured for coupling to a source of current for recharging said first battery, a tube coupled to a top of said respective said shell, said tube being open-ended, a motor coupled to and positioned within said tube such that a shaft of said motor extends from said motor toward said rear of said respective said shell, a receiver operationally coupled to said first power module and said motor, and a plurality of blades coupled to and extending from said shaft, wherein said blades are positioned on said shaft such that said motor is positioned for rotating said blades concurrent with said shaft for expelling air from said tube for propelling said respective said shell along said panel;

a plurality of controllers, each said controller being operationally coupled to a respective said blower module such that said controller is positioned for commanding said respective said blower module for selectively expelling the air for propelling said respective said shell along said panel with said respective said rail positioned for guiding said respective said shell along said panel, each said controller comprising:

a housing defining an interior space, a second power module coupled to said housing and positioned in said interior space, said second power module comprising a second battery, a transmitter coupled to said housing and positioned in said interior space, said transmitter being operationally coupled to said second power module, an antenna coupled to and extending from said housing, said antenna being operationally coupled to said transmitter, and a knob rotationally coupled to said housing, said knob being operationally coupled to said transmitter, wherein said knob is positioned on said housing such that said knob is positioned for selectively turning for signaling said transmitter for wirelessly communicating a respective rotational speed for said shaft to said motor via said receiver such that a user is positioned for controlling a speed of said respective said shell;

a plurality of light emitting diodes, said light emitting diodes being coupled to said top of said respective said shell, said light emitting diodes being operationally coupled to said first power module such that said light emitting diodes are positioned for illuminating said respective said shell; and wherein said shell, said panel and said rails are magnetized such that each said shell is repelled by said panel and said respective said rail for levitating said shell above said panel, wherein said controller is positioned for commanding said respective said blower module for selectively expelling the air for propelling said respective said shell along said panel with said respective said rail positioned for guiding said respective said shell along said panel.

* * * * *